US005885926A

United States Patent [19]

Matsumoto

[11] Patent Number: 5,885,926

[45] Date of Patent: Mar. 23, 1999

[54] HEAT SENSITIVE COLOR RECORDING MATERIAL

[75] Inventor: Shinichi Matsumoto, Takatsuki, Japan

[73] Assignee: Naigai Carbon Ink Co., Ltd., Osaka-Fu, Japan

[21] Appl. No.: 782,463

[22] Filed: Jan. 10, 1997

[30] Foreign Application Priority Data

Jan. 12, 1996 [JP] Japan ..... 8-004083

[51] Int. Cl.[6] ..... B41M 5/035; B41M 5/34; B41M 5/35

[52] U.S. Cl. ..... 503/204; 503/205; 503/207; 503/215; 503/227

[58] Field of Search ..... 8/471; 428/195, 428/913, 914; 503/204, 227, 205, 207, 215

[56] References Cited

U.S. PATENT DOCUMENTS

| | | | |
|---|---|---|---|
| 4,500,896 | 2/1985 | Matsumoto | 428/204 |
| 4,620,204 | 10/1986 | Inaba et al. | 503/204 |

FOREIGN PATENT DOCUMENTS

| | | | |
|---|---|---|---|
| 55-7449 | 1/1980 | Japan | 503/204 |
| 55-7450 | 1/1980 | Japan | 503/204 |
| 59-192591 | 10/1984 | Japan | 503/226 |
| 4-32752 | 6/1992 | Japan | 503/205 |
| 5-185715 | 7/1993 | Japan | 503/204 |
| 5-193254 | 8/1993 | Japan | 503/204 |
| 5-201127 | 8/1993 | Japan | 503/204 |
| 2 202 958 | 10/1988 | United Kingdom | 503/213 |

*Primary Examiner*—Bruce H. Hess
*Attorney, Agent, or Firm*—Merchant, Gould, Smith, Edell, Welter & Schmidt

[57] ABSTRACT

The present invention provides a heat sensitive multiple color recording material which produces different color tone by changing applied thermal energy and which has stable developed color image and little color mixture. The heat sensitive color recording material comprises: (a) a substrate, (b) a sublimable dye coloring layer, formed on the substrate (a), and (c) at least one leuco dye color-developing layer, formed on the sublimable dye coloring layer (b), wherein the sublimable dye coloring layer (b) is composed of a sublimable dye layer and a thermoplastic resin layer for fixing the sublimable dye. The leuco dye color-developing layer (c) contains a leuco dye and a developing agent for the leuco dye, and also contains, either within the leuco dye color-developing layer (c) or as an adjacent layer, microcapsules containing a color eraser for erasing the developed color. The color development of the leuco dye color developing layer (c) occurs a temperature lower than that of the sublimable dye, and the developed color of the leuco dye color developing layer (c) is erased by the function of the color eraser emitted from the microcapsules at a temperature which develops color in the sublimable dye coloring layer (b).

9 Claims, 1 Drawing Sheet

HEAT SENSITIVE COLOR RECORDING MATERIAL

FIELD OF THE INVENTION

The present invention relates to a heat sensitive color recording material in which a color image is formed by applying heat from a heat element, such as a thermal head. More particularly, the present invention relates to a heat sensitive color recording material composed of at least two color-developing layers which produce different colors by changing thermal energy given by a thermal head, so as to produce two or more color images.

BACKGROUND OF THE INVENTION

A heat sensitive paper widely known to the art comprises a leuco dye and a color developing agent and can produce color by the application of heat from a heating element, such as a thermal head. The heat sensitive paper is generally used for a recording material for a facsimile, a printer etc., because it is produced at low cost and necessitates a relatively small apparatus which is easily treated by an operator.

On the other hand, multiple color or full color recording has been recently required together with the extended utility of recording apparatus. The full color requirement generally uses electrostatic recording using laser light, ink-jet printing, heat transfer film and the like, but heat sensitive paper has not been employed. A full color recording material using the characteristics of heat sensitive paper wherein a multiple color image will be obtained by changing the heat energy applied by a thermal head is also desired.

For this purpose, an attempt is considered that the developing color tone is changed in concord with the thermal energy applied from a thermal head, using a combination of leuco dye and developing agent. For example, a combination of a low-temperature color-developing layer and a high-temperature color-developing layer that create different color tones is formed and changes developing color tone by change of the thermal energy. In the method, however, the high-temperature color developing layer is developed at a high temperature which is also developing the low-temperature color-developing layer. Thus, the developed color at the high temperature must be a mixed color. It is difficult to obtain the original color tone of each leuco dye originally has.

In order to improve the above defect, it is proposed that a color eraser which erases the developed color of the low-temperature color-developing layer at the high temperature is used to give the developed color of the high-temperature color-developing layer while erasing the color of the low-temperature color-developing layer. The heat sensitive multiple color recording materials using the color eraser are disclosed in Japanese Kokai Publications, Sho 55 (1980)-7449, Sho 55(1980)-7450, Hei 5(1993)-185715, Hei 5(1993)-193254 and Hei 5(1993)-201127 and Japanese Kokoku Publication Hei 4(1992)-32752; or U.S. Pat. No. 4,620,204. However, it is still difficult to inhibit color mixture and it is very hard to keep the developed color tones completely separated from each other. It is also very difficult to obtain heat sensitive multiple color recording materials of three or more colors. In addition, the developed color is gradually color-changed or discolored by the function of the color eraser when time goes on.

OBJECT OF THE INVENTION

An object of the present invention is to obtain a heat sensitive multiple color recording material which produces different color tones by changing the applied thermal energy and which has stable developed color image and little color mixture.

SUMMARY OF THE INVENTION

Thus, the present invention provides a heat sensitive color recording material comprising:

(a) a substrate, (b) a sublimable dye coloring layer, formed on the substrate (a), and (c) at least one leuco dye color-developing layer, formed on the sublimable dye coloring layer (b), wherein the sublimable dye coloring layer (b) is composed of a sublimable dye layer and a thermoplastic resin layer for fixing the sublimable dye, the leuco dye color-developing layer (c) contains a leuco dye and a developing agent for the leuco dye, and also contains, either within the leuco dye color-developing layer (c) or as an adjacent layer, microcapsules containing a color eraser for erasing the developed color.

The color development of the leuco dye color developing layer (c) occurs a temperature lower than that of the sublimable dye, and the developed color of the leuco dye color developing layer (c) is erased by the function of the color eraser emitted from the microcapsules at a temperature which develops color in the sublimable dye coloring layer (b).

In the present invention, a coloring layer composed of a layer containing sublimable dye and a sublimable dye fixing layer is formed on a substrate and then a color-developing layer containing leuco dye and its developer is formed thereon. And, a color eraser is encapsulated into a microcapsule and is either contained within the leuco dye-containing layer or present as a separate layer adjacent to the leuco dye-containing layer. The above features sufficiently inhibit the color mixture and easily produce each color tone by changing the thermal energy obtained from a heating element, such as a thermal head. The present invention can also provide a full color (more than three colors) recording material.

DETAILED DESCRIPTION OF THE INVENTION

Figure 1:
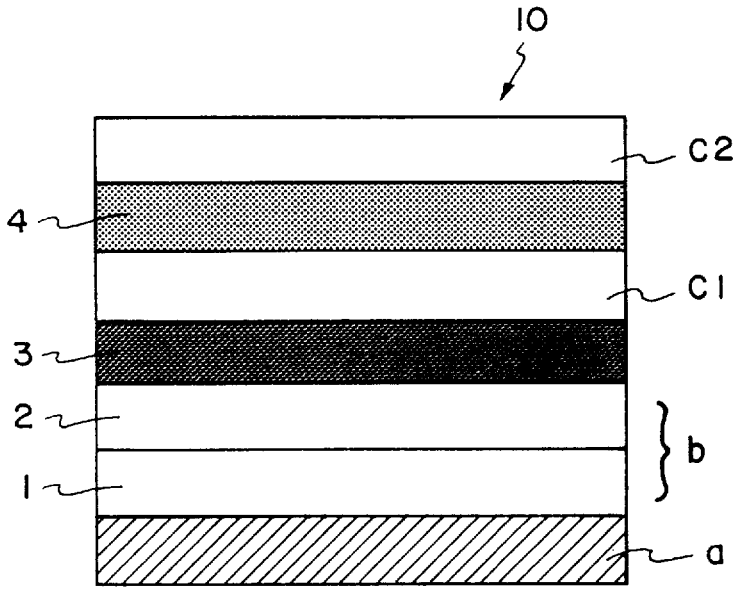
FIG. 1 shows a schematic sectional view of one representative example of the present invention.

The present invention will be explained with reference with FIG. 1. On a substrate a formed from wood free paper, polyester film or the like, a lowermost sublimable dye coloring layer b composed of a sublimable dye layer 1 and a sublimable dye fixing layer 2 is formed. On the layer b, a medium temperature color-developing layer c1 is formed, and the layer c1 contains a leuco dye and a developing agent which develop a color tone different from the sublimable dye. In the present invention, a color eraser that erases the developed color of the medium temperature color-developing layer c1 is encapsulated into microcapsules and is either contained in the layer c1 or present as a separate layer adjacent to the layer c1, but in FIG. 1, the microcapsule-containing layer 3 is formed between the medium temperature color-developing layer c1 and the sublimable dye fixing layer 2. Then, a low temperature color-developing layer c2 which contains a leuco dye and a developing agent is formed on the layer c1 and the leuco dye develops a color tone different from that of the sublimable dye coloring layer b and the medium temperature color-developing layer c1. For the layer c2, a color eraser-containing microcapsule is either contained in the layer c2 or present as a separate layer adjacent to the layer c2, but in FIG. 1, the microcapsule-containing layer 4 is formed between the layer c2 and the layer c1. This construction makes it possible to produce a color tone separated from the other two colors, by applying suitable thermal energy.

When a low temperature is applied to the recording material of the present invention, the uppermost low temperature color-developing layer c2 develops color in the portion on which the thermal energy is applied. When a medium temperature is applied, the medium temperature color-developing layer c1 develops color in the portion on which the thermal energy is applied, and simultaneously the microcapsules contained in the microcapsule layer 4 are destroyed or swollen to emit the color eraser which erases the color developed by the low temperature color-developing layer c2. Accordingly, a colored image formed by the color development of the medium temperature color-developing layer c1 is formed without color mixture. When a high temperature is applied, the sublimable dye is fixed in the sublimable dye fixing layer 2 to develop color, and simultaneously the colors developed in both the low temperature color-developing layer c2 and the medium temperature color-developing layer c1 are erased by each color eraser emitted from the microcapsules. Accordingly, a colored image formed by the sublimable dye color-developing layer b is formed without color mixture with the other two colors. As the result, the portion on which no thermal energy is applied remains white as the color of the substrate a, the portion on which a low temperature is applied develops the color image of the low temperature color-developing layer c2, the portion on which a medium temperature is applied develops the color image of the medium temperature color-developing layer c1 and the portion on which the high temperature is applied develops the color image of the sublimable dye color-developing layer b.

The above embodiment shows an example having two leuco dye color-developing layers, which produces three colors. In case where one leuco dye color-developing layer is formed on the sublimable dye color-developing layer, the recording material merely produces two color image. Of course, in a case where the number of the leuco dye color-developing layers increases, more than three color images can be theoretically obtained.

The color eraser-containing microcapsules may be uniformly dispersed in the leuco dye color-developing layer or may be separately formed as one layer adjacent to the leuco dye color-developing layer. The microcapsule-containing layer is formed on the leuco dye color-developing layer, but it may be formed either up or down the leuco dye color-developing layer. Since the color eraser is protected by the microcapsule, it is stable. In case where the microcapsules are formulated into the leuco dye color-developing layer, it is preferred that they are uniformly dispersed therein in view of color erasing effect.

The leuco dye formulated into the leuco dye color-developing layer in the present invention is known to the art and generally described in Japanese Kokai Publication Hei 5(1993)-201127, Japanese Kokoku Publication Hei 5(1993)-71395 or U.S. Pat. Nos. 3,843,384, 4,311,750 and 4,620,204, which are incorporated herein, and the like, in which colorless or light color dyes are preferable. Typical examples of the leuco dyes are triarylmethanes, diphenylmethanes, xanthenes, thiazines, spiropiranes and mixtures thereof. The leuco dye has an inherent developing temperature, but the temperature can be controlled by combining with a sensitizer. If the embodiment of FIG. 1 is exemplified, the leuco dye color-developing layer c2 preferably has a developing temperature of 80° to 95° C., more preferably 85° to 90° C., for which the leuco dye can be a combination of 3,3-bi(p-dimethylaminophenyl)-6-dimethylaminophthalide (Crystal violet lactone) with dibenzyl oxalate as sensitizer. The leuco dye color-developing layer c1 preferably has a developing temperature of 105° to 120 ° C., more preferably 110° to 120° C. and the difference of the color-developing layers c1 and c2 may be 10° to 40° C., preferably 20° to 40° C. The leuco dye preferably used for the color-developing layer c1 can be 3-diethylamino-6-methyl fluoran, 3-diethylamino-5-ethyl-7-chlorofluoran and the like.

The developing agent used in combination with the leuco dye in the present invention is known to the art and can be as disclosed in Japanese Kokai Publication Hei 5(1993)-201127, Japanese Kokoku Publication Hei 5(1993)-71395, Paper Pulp Technical Times published in 1985, pages 49–54 and pages 65–70 or U.S. Pat. Nos. 3,843,384, 4,311,750 and 4,620,204, which are incorporated herein. Typical examples of the developing agents are phenols, triphenylmethanes, sulfur-containing phenols, sulfons, urea, thiourea and the like.

The leuco dye color-developing layer is generally formed from a coating solution which contains a leuco dye and a developing agent and optionally contains a binder, an inorganic pigment, a sensitzer, a lubricant and other additives. The leuco dye and developing agent are separately put in an aqueous solution and dispersed and ground into less than several micron particles by a ball mill, an attritor, a sand grinder or the like and then mixed, followed by adding the other components, such as a binder etc.

The binder is also known to the act, for example, starch, methylcellulose, polyvinyl alcohol, carboxyl-modified polyvinyl alcohol, polyacrylamide and the like. Typical examples of the inorganic pigments are kaolin, clay, calcium carbonate, particulate silica anhydride and like. Typical examples of the sensitizers are aliphatic amides, aromatic carboxylates, aliphatic esters, aromatic ethers and the like. These are all described in the above mentioned Kokai and Kokoku or English language publications.

The amounts of the above mentioned components are not limited and vary by color tone, sensitivity to thermal energy, recording performance and so on. Generally, the developing agent may be present in an amount of 3 to 12 parts by weight, the sensitizer in an amount of 0 to 12 parts by weight, the inorganic pigment in an amount of 1 to 20 parts by weight and the binder in an amount of 10 to 25 parts by weight, all parts by weight being based on one part by weight of the leuco dye.

The color eraser used in the present invention is also known to the art and includes aliphatic amines, amides, piperidines, piperazines, pyridines, imidazoles, imidazolines, morpholines, guanidines, amidines, polyethers, glycols and derivatives thereof. Representative examples of the color erasers are disclosed in Japanese Kokai Publications Sho 55(1980)-25306, Sho 55(1980)-27217, Sho 55(1980)-152094, Sho 55(1980)-139290, Sho 55(1980)-152094, Sho 56(1981)-40588, Sho 50(1975)-15048 and Sho 64(1989)82986, Japanese Kokoku Publications Sho 50(1975)-17867, Sho 50(1975)-17868, Sho 51(1976)-29024 or U.S. Pat. Nos. 3,843,384, 4,311,750 and 4,620,204, which are incorporated herein, and the like. Preferred is one which is insoluble or little soluble in water and soluble in organic solvent. More preferred are guanidine compounds and guanidine derivatives. An amount of the eraser used for the recording material of the present invention can be enough to erase the developed color and can generally be 50 to 1,000% by weight based on the total weight of the leuco dye and developing agent. Actually, the amount is experimentally determined.

The color eraser-containing microcapsules used in the present invention may be produced by dissolving or dispersing the color eraser in an organic solvent which is little soluble or insoluble in water and then encapsulating by interfacial polymerization. Examples of the organic solvents are triarylmethanes, ter-phenyl compounds, alkylated diphenyl ether, hydrogenated ter-phenyls, diphenyl ethers, mixtures thereof and the like. In the organic solvent, a co-solvent having a lower boiling point can be added and examples of the co-solvents are ethyl acetate, isopropyl acetate, butyl acetate and the like.

The shell for the microcapsules is formed from polyurethane, polyurea, polyamide, polyester, polycarbonate, urea-formaldehyde resin, melamine resin, gelatine, a mixture thereof and the like. In the present invention, the microcapsules preferably can be formed from polyurethane, polyurea, polyarnide, and polyester. Most preferred are polyurethane-polyurea, polyurethane and polyurea.

The microcapsules may be produced by emulsifying a color eraser mixture of a color eraser and an organic solvent in an aqueous solution of polyvinyl alcohol and the like, and then adding monomers into the eraser mixture and/or the aqueous solution to polymerize them. The method for forming the microcapsules is known to the art. For example it is explained in "Microencapsulation", edited by J. R. Nixon, Marcel Dekker, Inc., 1976, Chapter 2 and the like.

The microcapsules obtained above, when heat is applied, may be destroyed and the color eraser escapes to the outside. Since it is not necessary that the microcapsules are actually destroyed, the color eraser may be emitted through the shell layer to the outside without destroying the capsule. It is therefore necessary that the microcapsules are heat sensitive. In this context, the term "heat sensitive" means that when heat is applied, the inside content of the microcapsule is emitted to outside and when heat is not applied, the inside content of the microcapsule stably remains inside the capsule, separated from the outside of the microcapsule. The use of the microcapsules containing a color eraser keep the developed color stable and, once the color eraser is emitted to outside, the developed color completely vanishes.

The color eraser-containing microcapsules are directly formulated into the coating solution of the leuco dye color-developing layer. When a microcapsule layer is formed adjacent to the leuco dye color-developing layer, it may be formed from a microcapsule solution which contains the microcapsules and optionally a binder, solvent and other additives. Examples of the binders are polyvinyl alcohol, starch, styrene-butadiene latex, acrylate emulsion and the like. The microcapsule solution may be applied on either side of the leuco dye color-developing layer and therefore can be either overcoated or undercoated on the leuco dye color-developing layer.

The sublimable dye coloring layer used in the present invention is formed from a combination of a layer containing sublimable dye and a layer containing thermoplastic resin. Colorless sublimable dye is rare and the dye generally has its color. Accordingly, the thermoplastic resin is combined with white pigment, such as titanium oxide and present over the sublimable dye layer to conceal the color of the sublimable dye. When a high temperature is applied on the recording material of the present invention, the sublimable dye sublimes and transfers to the thermoplastic resin layer in which the thermoplastic resin is softened or melted, to trap the dye and thus develop the color.

As suggested in the prior art, if one obtains a multiple color recording material by only using leuco dye, its developing agent and its color eraser, a color mixture of the developed color often occurs and it is very difficult to separate each developed color from the other developed colors. This problem has seriously happened when three or more color developing material is formed. The present inventors have introduced the sublimable dye coloring layer, which has a color-developing mechanism different from the leuco dye and makes it possible to clearly separate each developed color, thus obtaining a heat sensitive multiple color recording material.

The sublimable dye used in the present invention is all art known, but in case of the embodiment of FIG. 1, it sublimes or vaporizes at a temperature of 180° to 250° C. and has a color-developing temperature 20° to 80° C. higher than the medium temperature color-developing layer c1. The sublimable dye includes disperse dye and oil-soluble dye, for example C.I. Disperse Yellow 1, 3, 9,16, 41, 54, 60, 77, 116 etc.; C.I. Disperse Red 1, 4, 6, 11, 15, 17, 55, 59, 60, 73, 83 etc.; C.I. Disperse Blue 3, 14, 19, 26, 55, 60, 64, 72, 99, 108 etc.; C.I. Solvent Yellow 77, 116 etc.: C.I. Solvent Red 23, 25, 27 etc.; C.I. solvent Blue 36, 83, 105 etc.; and the like. The sublimable dye can be used solely or in combination. The sublimable dye is generally selected to be suitable to the thermal energy applied by a heat element.

The sublimable dye layer is formed from a coating solution which contains a sublimable dye, a solvent, a binder and optionally a sensitizer or an inorganic dye. Examples of the solvents are aromatic hydrocarbons, such as toluene, hexane; ketones, such as methyl ethyl ketone; esters, such as ethyl acetate; alcohols, such as methyl alcohol and ethyl alcohol; and the like. Examples of the binders are polyvinyl chloride, polyvinyl acetate, polyvinyl butyral, cellulose lactate, polyamide, polyacrylate, polystyrene and a mixture thereof. Typical examples of the sensitizers are aliphatic amides, aromatic carboxylates, aliphatic esters, aromatic ethers and the like. Examples of the inorganic pigment are the same as explained in the leuco dye color-developing layer. The above coating solution for the sublimable dye layer is solvent base, but it can also be aqueous type using a combination of aqueous solution and aqueous binder instead of the organic solvent and solvent base binder. Examples of the aqueous binders are polyvinyl alcohol, styrene-butadiene latex, acrylate emulsion and the like.

The thermoplastic resin used for the sublimable dye fixing layer can be any thermoplastic resin which is known to the art. In view of coloring ability, preferred is polyester resin. The thermoplastic resin in the thermoplastic resin layer may either form a coating layer or be present as particles uniformly dispersed therein. In view of the function to trap the sublimable dye, the larger a surface area of the resin, the better. Accordingly, the thermoplastic resin layer is preferably formed from a polyester dispersion with finely dispersed polyester resin particles. It is preferred that the thermoplastic resin is preferably softened or melted by applied heat, in view of the trapping performance of the dye sublimated from the sublimable dye layer. The thermoplastic resin, therefore, has a relatively low molecular weight. A preferred example of the thermoplastic resin is polyester resin which has a particle size of less than 10 $\mu$m, preferably 0.5 to 2.0 μm and has a glass transition temperature of less than 100° C., preferably 80 to 90 ° C. Many polyester dispersions which satisfy the above requirement are commercially available, for example aqueous polyester dispersion available from Nippon Synthetic Chemical Co., Ltd. as Polyester which contains about 20% by weight polyester resin particle having a particle size of less than 5 μm and a glass transition temperature of 57° C.

The thermoplastic resin layer contains an inorganic pigment for concealing the color of the sublimable dye present under the thermoplastic resin layer, as explained above. The inorganic pigment can be anyone which has opacifying power, for example titanium oxide, clay, talc, silica, magnesium carbonate, alumina, aluminum hydroxide, magnesium hydroxide, kaoline, zinc oxide, calcium carbonate, aluminum oxide and the like. Preferred is titanium oxide; in view of its opacifying power.

The thermoplastic resin layer can contain other additives which are used for the leuco dye color-developing layer, such as a sensitizer, if necessary. The sensitizer can be the same as listed for the leuco dye color-developing layer, but includes aliphatic amides, aromatic carboxylates, aliphatic esters, aromatic ethers and the like.

The thermoplastic resin may be contained in the thermoplastic resin layer in an amount of 2 to 50 parts by weight, preferably 5 to 10 parts by weight, based on one part by weight of the sublimable dye. The inorganic pigment may be contained in the thermoplastic resin layer in an amount of 5 to 16 parts by weight, preferably 8 to 10 parts by weight, based on one part by weight of the sublimable dye.

The thermoplastic resin layer may be formed by coating an aqueous thermoplastic resin solution. The aqueous thermoplastic resin solution may be preferably obtained by finely dispersing the inorganic pigment with an aqueous binder by an attritor, a ball mill, a sand grinder or the like, and then adding the above mentioned aqueous thermoplastic resin dispersion thereto. Typical examples of the aqueous binders are polyvinyl alcohol, styrene-butadiene latex, starch, polyacrylamide and the like.

The coating solutions for the sublimable dye layer and the thermoplastic resin layer are applied on a substrate by a conventional coating method, such as wire bar, air knife, roll, gravure screen or a blade. The substrate can be formed from pulp paper, wood free paper, condenser paper, cellophane, polyethylene, polyester, but preferred are wood free paper and polyester film. The substrate may form an anchor coating before applying the sublimable dye layer, in view of the prevention of infiltration of the coating solution or the prevention of sublimation of the dye. The anchor coating may be formed from an art-known resin solution.

As mentioned above, the sublimable dye coloring layer is formed on the substrate and then dried. On the sublimable dye color-developing layer, a leuco dye color-developing layer is formed and color eraser-containing microcapsules may be either formulated in the leuco dye color-developing layer or formed as a separate layer. In case of the three color recording material, another leuco dye color-developing layer is formed and color eraser-containing microcapsules may also be either formulated in the leuco dye color-developing layer or formed as a separate layer. A coating amount of each layer is not specifically limited and varies depending on color density, heat sensitivity, color erasing effect and the like, but the sublimable dye layer has a coating amount of 0.05 to 5 g/m$^2$, the thermoplastic resin layer for fixing the sublimable dye has a coating amount of 1 to 10 g/m$^2$, the leuco dye color-developing layer has a coating amount of 2 to 12 g/m$^2$, preferably 3 to 7 g/m$^2$, and the microcapsule layer, if any, has a coating amount of 2 to 15 g/m$^2$.

If necessary, a screening layer may be disposed between the sublimable dye coloring layer and the leuco dye color-developing layer or between the two leuco dye color-developing layers, for the prevention of infiltration or mixture of the components therebetween. An intermediate layer for giving the gradient of temperature may also be formed. In addition, a protecting layer may be formed on the uppermost leuco dye color-developing layer.

EXAMPLES

The present invention is further illustrated by Examples which, however, are not to be construed as limiting the present invention to their details.

Example 1

On a sheet of wood free paper having 55 g/m$^2$, the following four layers were formed by coating each solution with a wire bar coater from a surface in this order, thus obtaining a heat sensitive two color recording paper.

(I) Sublimable dye layer Coating amount=2 g/m$^2$ (II) Sublimable dye fixing layer Coating amount=4 g/m$^2$ (III) Color eraser-containing Coating amount=6 g/m$^2$ microcapsule layer (IV) Leuco dye color-developing Coating amount=2 g/m$^2$ layer (I) The coating solution (I) w as prepared by mixing the following ingredients.

| Ingredients | Parts by weight |
|---|---|
| Toluene | 400 |
| Methyl ethyl ketone | 400 |
| Denka Vinyl # 1000 AKT *1 | 100 |
| Kaya Set Yellow-AG *2 | 40 |
| Aerosil #200 *3 | 30 |

*1 Polyvinyl resin having a molecular weight of 60,000 to 75,000 and a glass transition temperature of 65° C., available from Denki Kagaku Kogyo K.K.
*2 A yellow sublimable dye available from Nippon Kayaku Co., Ltd.
*3 Silica fine powder available from Nippon Aerosil Co., Ltd.

(II) A coating solution (II) for the sublimable dye fixing layer was prepared by mixing the following ingredients.

(III) Preparation of a coating solution for the color eraser containing-microcapsule layer:

| Ingredients | Parts by weight |
|---|---|
| Aqueous polyester resin *4 | 700 |
| Titanium oxide | 300 |
| Aerosil #200 *3 | 20 |

*4 Polyester resin dispersion containing polyester resin particle having a particle size of 0.5 to 2.0 μm and a molecular weight of 29,400, available from Nippon Synthetic Chemical Industries Ltd.

A mixture of 35 parts by weight of Highsol SAS-296 (aromatic hydrocarbon having 2 rings (1-phenyl-1-xylylethane) available from Nippon Oil Co., Ltd.), 30 parts by weight of Sumidur N-75S (aliphatic polyisocyanate) available from Sumitomo Bayer Urethane Co., Ltd.) and 10 parts by weight of Soxinol-DT (di-o-tolylguanidine available from Sumitomo Chemical Co., Ltd.) was emulsified in 200 parts by weight of 20% polyvinyl alcohol solution by a homomixer or a disperser to form an emulsion having a particle size of 2 to 5 μm. Into the emulsion, a 5% aqueous solution of Epicure (a curing agent for epoxy resin available from Yuka Shell Epoxy Co., Ltd.) was dropped and heated to 40° C. to form a coating solution containing a color eraser-containing microcapsules.

(IV) Preparation of a coating solution (IV) for the leuco dye color-developing layer Two solutions (A and B) were separately prepared by mixing the following ingredients, and then the two were mixed together to form a coating solution for the leuco dye red color-developing layer.

Solution A

| Ingredients | Parts by weight |
|---|---|
| Bisphenol A *5 | 300 |
| Calcium carbonate | 200 |
| 20% Polyvinyl alcohol solution *6 | 300 |
| Water | 400 |

*5 Available from Mitsubishi Chemical Co., Ltd.
*6 A polyvinyl alcohol aqueous solution having a molecular weight of 30,000, available from Nippon Synthetic Chemical Co., Ltd.

Solution B

| Ingredients | Parts by weight |
|---|---|
| Crystal Violet Lactone *7 | 100 |
| Calcium carbonate | 70 |
| 20% Polyvinyl alcohol solution *6 | 100 |
| Water | 330 |

*7 Red leuco dye available from Yamamoto Kasei K.K.

The heat sensitive two color recording paper obtained above was used in a thermal printer (Thermal Printer PW-PR01-02 available from Nippon Electric Co., Ltd.) and printed thereby. Blue color was developed at 2 output level and yellow color was developed at 5 output level without color mixture.

Example 2

On a sheet of wood free paper having 55 g/m$^2$, the following six layers were formed by coating each solution with a wire bar coater from a surface in this orders thus obtaining a heat sensitive three color recording paper.

(I) Sublimable dye layer Coating amount=2 g/m$^2$ (II) Sublimable dye fixing layer Coating amount=4 g/m$^2$ (III) Color eraser-containing Coating amount=6 g/m$^2$ microcapsule layer (IV) Leuco dye color-developing Coating amount=2 g/m$^2$ layer (V) Color eraser-containing Coating amount=6 g/m$^2$ microcapsule layer (VI) Leuco dye color-developing Coating amount=2 g/m$^2$ layer (I) The coating solution (I) was prepared by mixing the following ingredients.

| Ingredients | Parts by weight |
|---|---|
| Toluene | 400 |
| Methyl ethyl ketone | 400 |
| Denka Vinyl # 1000 AKT *1 | 100 |
| Kaya Set Yellow-AG *2 | 40 |
| Aerosil #200 *3 | 30 |

(II) A coating solution (II) for the sublimable dye fixing layer was prepared by mixing the following ingredients.

| Ingredients | Parts by weight |
|---|---|
| Aqueous polyester resin *4 | 700 |
| Titanium oxide | 300 |
| Aerosil #200 *3 | 20 |

(III) Preparation of a coating solution (III) for the color eraser containing-microcapsule layer:

A mixture of 35 parts by weight of Highsol SAS-296, 30 parts by weight of Sumidur N-75S and 10 parts by weight of Soxinol-DT was emulsified in 200 parts by weight of 20% polyvinyl alcohol solution by a homomixer or a disper to form an emulsion having a particle size of 2 to 5 $\mu$m. Into the emulsion, a 5% aqueous solution of Epicure was dropped and heated to 40° C. to form a coating solution containing a color eraser-containing microcapsules.

(IV) Preparation of a coating solution (IV) for the leuco dye color-developing layer Two solutions (A and B) were separately prepared by mixing the following ingredients, and then the two were mixed together to form a coating solution for the leuco dye red color-developing layer.

Solution A

| Ingredients | Parts by weight |
|---|---|
| 4-Hydroxy-4'-isopropoxyphenylsulfon | 300 |
| Calcium carbonate | 200 |
| 20% Polyvinyl alcohol solution *6 | 300 |
| Water | 400 |

Solution B

| Ingredients | Parts by weight |
|---|---|
| Vermillion DFC *8 | 100 |
| Calcium carbonate | 70 |
| 20% Polyvinyl alcohol solution *6 | 100 |
| Water | 330 |

*8 Red color leuco dye available from Hodogaya Chemical Co., Ltd.

(V) The coating solution (V) for the color eraser-containing microcapsules was the same as the coating solution (III).

(VI) Preparation of a coating solution for the leuco dye color-developing layer

Two solutions (C and D) were separately prepared by mixing the following ingredients, and then the two were mixed together to form a coating solution for the leuco dye blue color-developing layer.

Solution C

| Ingredients | Parts by weight |
|---|---|
| 4-Hydroxy-4'-isopropoxyphenylsulfon | 150 |
| Sensitizer *9 | 150 |
| Calcium carbonate | 200 |
| 20% Polyvinyl alcohol solution *6 | 300 |
| Water | 400 |

*9 Dibenzyl oxalate available from Dainippon Ink & Chemicals, Inc.

Solution D

| Ingredients | Parts by weight |
|---|---|
| Crystal Violet Lactone *7 | 100 |
| Calcium carbonate | 70 |
| 20% Polyvinyl alcohol solution *6 | 100 |
| Water | 330 |

The heat sensitive three color recording paper obtained above was used in a thermal printer (Thermal Printer PW-PR01-02 available from Nippon Electric Co., Ltd.) and printed thereby. Blue color was developed at 1 output level, red color was developed at 3 output level and yellow color was developed at 5 output level without color mixture.

Example 3

On a sheet of wood free paper having 55 g/m$^2$, the following three layers were formed by coating each solution with a wire bar coater from a surface in this order, thus obtaining a heat sensitive two color recording paper.

(I) Sublimable dye layer Coating amount=2 g/m$^2$ (II) Sublimable dye fixing layer Coating amount=4 g/m$^2$ (III) Leuco dye color-developing Coating amount 2 g/m$^2$ layer (I) The coating solution (I) was prepared by mixing the following ingredients.

| Ingredients | Parts by weight |
|---|---|
| Toluene | 400 |
| Methyl ethyl ketone | 400 |
| Denka Vinyl # 1000 AKT *1 | 100 |
| Kaya Set Yellow-AG *2 | 40 |
| Aerosil #200 *3 | 30 |

(II) A coating solution (II) for the sublimable dye fixing layer was prepared by mixing the following ingredients.

| Ingredients | Parts by weight |
|---|---|
| Aqueous polyester resin *4 | 700 |
| Titanium oxide | 300 |
| Aerosil #200 *3 | 20 |

(III) Preparation of a coating solution (III) for the leuco dye color-developing layer Three solutions (A, B and C) were separately prepared by mixing the following ingredients, and then the three were mixed together in a weight ratio of A:B:C=2:1:1 to form a coating solution for the leuco dye red color-developing layer.

Solution A

| Ingredients | Parts by weight |
|---|---|
| Bisphenol A *5 | 150 |
| Sensitizer *9 | 150 |
| Calcium carbonate | 200 |
| 20% Polyvinyl alcohol solution *6 | 300 |
| Water | 400 |

Solution B

| Ingredients | Parts by weight |
|---|---|
| Vermilion DCF *8 | 100 |
| Calcium carbonate | 70 |
| 20% Polyvinyl alcohol solution *6 | 100 |
| Water | 330 |

Solution C

A mixture of 35 parts by weight of Highsol SAS-296, 30 parts by weight of Sumidur N-75S and 10 parts by weight of Soxinol-DT was emulsified in 200 parts by weight of 20% polyvinyl alcohol solution by a homomixer or a disper to form an emulsion having a particle size of 2 to 5 $\mu$m. Into the emulsion, a 5% aqueous solution of Epicure was dropped and heated to 40° C. to form a solution containing a color eraser-containing microcapsules.

The heat sensitive two color recording paper obtained above was used in a thermal printer (Thermal Printer PW-PR01-02 available from Nippon Electric Co., Ltd.) and printed thereby. Red color was developed at 2 output level and yellow color was developed at 5 output level without color mixture.

Example 4

On a sheet of wood free paper having 55 g/m$^2$, the following five layers were formed by coating each solution with a wire bar coater from a surface in this order, thus obtaining a heat sensitive two color recording paper.

(I) Sublimable dye layer Coating amount=2 g/m$^2$ (II) Sublimable dye fixing layer Coating amount=4 g/m$^2$ (III) Color eraser-containing Coating amount=6 g/m$^2$ microcapsule layer (IV) Leuco dye color-developing Coating amount=2 g/m$^2$ layer (Red)

(V) Leuco dye color-developing Coating amount=2 g/m$^2$ layer (Blue)

(I) The coating solution (I) was prepared by mixing the following ingredients.

| Ingredients | Parts by weight |
|---|---|
| Toluene | 400 |
| Methyl ethyl ketone | 400 |
| Denka Vinyl #1000 AKT*1 | 100 |
| Kaya Set BLACK-922*10 | 40 |
| Aerosil #200*3 | 30 |

*10 Black sublimable dye available from Nippon Kayaku Co., Ltd.

(II) A coating solution (II) for the sublimable dye fixing layer was prepared by mixing the following ingredients.

| Ingredients | Parts by weight |
|---|---|
| Aqueous polyester resin*4 | 700 |
| Titanium oxide | 300 |
| Aerosil #200*3 | 20 |

(III) Preparation of a coating solution (III) for the color eraser containing-microcapsule layer:

A mixture of 35 parts by weight of Highsol SAS-296, 30 parts by weight of Sumidur N-75S and 10 parts by weight of Soxinol-DT was emulsified in 200 parts by weight of 20% polyvinyl alcohol solution by a homomixer or a disper to form an emulsion having a particle size of 2 to 5 $\mu$m. Into the emulsion, a 5% aqueous solution of Epicure was dropped and heated to 40° C. to form a coating solution containing a color eraser-containing microcapsules.

(V) Preparation of a coating solution (IV) for the leuco dye color-developing layer Two solutions (A and B) were separately prepared by mixing the following ingredients, and then the two were mixed together to form a coating solution for the leuco dye red color-developing layer.

Solution A

| Ingredients | Parts by weight |
|---|---|
| 4-Hydroxy-4'-isopropoxyphenylsulfon | 300 |
| Calcium carbonate | 200 |
| 20% Polyvinyl alcohol solution*6 | 300 |
| Water | 400 |

Solution B

| Ingredients | Parts by weight |
|---|---|
| Vermilion DFC*8 | 100 |
| Calcium carbonate | 70 |
| 20% Polyvinyl alcohol solution*6 | 100 |
| Water | 330 |

(V) Preparation of a coating solution (V) for the leuco dye color-developing layer Two solutions (C and D) were separately prepared by mixing the following ingredients, and then the two were mixed together to form a coating solution for the leuco dye blue color-developing layer.

Solution C

| Ingredients | Parts by weight |
|---|---|
| Bisphenol A*5 | 150 |
| Sensitizer*9 | 150 |
| Calcium carbonate | 200 |
| 20% Polyvinyl alcohol solution*6 | 300 |
| Water | 400 |

Solution D

| Ingredients | Parts by weight |
|---|---|
| Crystal Violet Lactone*7 | 100 |
| Calcium carbonate | 70 |
| 20% Polyvinyl alcohol solution*6 | 100 |
| Water | 330 |

The heat sensitive three color recording paper obtained above was used in a thermal printer (Thermal Printer PW-PR01-02 available from Nippon Electric Co., Ltd.) and printed thereby. Blue color was developed at 1 output level, violet color was developed at 3 output level and black color was developed at 5 output level without color mixture.

What is claimed is:

1. A heat sensitive color recording material comprising:

(a) a substrate, (b) a sumlimable dye coloring layer, formed on the substrate (a), and (c) at least one leuco dye color-developing layer, formed on the sublimable dye color-developing layer (b), wherein the sublimable dye coloring layer (b) is composed of a sublimable dye layer and a thermoplastic resin layer for fixing the sublimable dye, the leuco dye color-developing layer (c) contains a leuco dye and a developing agent for the leuco dye, and also contains, either within the leuco dye color-developing layer (c) or as an adjacent layer, microcapsules containing a color eraser for erasing the developed leuco dye color, the color development of the leuco dye color developing layer (c) occurs at a temperature lower than that of the sublimable dye, and the developed color of the leuco dye color developing layer (c) is erased by the function of the color eraser emitted from the microcapsules at a temperature which develops color in the sublimable dye coloring layer (b).

2. The heat sensitive color recording material according to claim 1 wherein, when said leuco dye color-developing layer (c) exists as two layers, the color development of one ($c_1$)of the two layers occurs at a temperature lower than the color development of the other leuco dye color-developing layer ($c_2$) and the developed color of the $c_1$ is erased at a color developing temperature of the $c_2$ layer.

3. The heat sensitive color recording material according to claim 2, wherein the recording material is composed of a substrate (a), a yellow sublimable dye coloring layer (b) is formed on the substrate (a), a red leuco dye color-developing layer ($c_r$) is formed on the layer (b) and a blue leuco dye color-developing layer ($c_b$) is formed on the layer ($c_r$), wherein the outermost layer ($c_b$) color-develops at a lowest temperature, the red leuco dye color-developing layer ($c_r$) color-develops at a temperature higher than the color-developing temperature of the $c_b$ layer and lower than that of the b layer, and at which the developed color of the $c_b$ layer is erased, and the sublimable dye color-developing layer (b) color-develops at a highest temperature at which the color of the other layers is erased.

4. The heat sensitive color recording material according to claim 1 wherein the microcapsule comprises the color eraser and a shell layer surrounding the eraser, the shell layer being formed from one selected from the group consisting of polyurea, polyurethane and polyurethane-polyurea.

5. The heat sensitive color recording material according to claim 1 wherein the thermoplastic resin layer for fixing the sublimable dye is composed of polyester resin particles and titanium oxide.

6. The heat sensitive color recording material according to claim 1 wherein the sublimable dye layer further contains a sensitizer.

7. The heat sensitive color recording material according to claim 1 wherein the thermoplastic resin layer for fixing the sublimable dye further contains a sensitzer.

8. The heat sensitive color recording material according to claim 1 wherein the color eraser is a guanidine compound.

9. The heat sensitive color recording material according to claim 1 wherein the substrate (a) is wood free paper or polyester film.

* * * * *